United States Patent [19]

Smith et al.

[11] 4,402,384

[45] Sep. 6, 1983

[54] SOUND BARRIER SYSTEM

[75] Inventors: Jack B. Smith; Barry W. Holden; Robert H. Tanner, all of Thomson, Ga.

[73] Assignee: Hoover Universal, Inc., Ann Arbor, Mich.

[21] Appl. No.: 318,129

[22] Filed: Nov. 4, 1981

[51] Int. Cl.[3] ..... G10K 11/00

[52] U.S. Cl. ..... 181/210; 181/284

[58] Field of Search ..... 181/210, 284, 287, 290; 244/114 B; 160/229 R; 52/155-165, 276-278, 144, 145

[56] References Cited

U.S. PATENT DOCUMENTS

| | | | |
|---|---|---|---|
| 2,872,710 | 2/1959 | Cox | 181/290 X |
| 3,011,597 | 12/1961 | Galloway et al. | 52/156 X |
| 3,070,646 | 12/1962 | Lindgren | 52/277 X |
| 3,592,289 | 7/1971 | Aysta et al. | 181/287 X |
| 3,630,310 | 12/1971 | Federer | 181/210 |
| 3,698,147 | 10/1972 | Sikes | 52/276 |
| 4,325,457 | 4/1982 | Docherty et al. | 181/210 |

*Primary Examiner*—Benjamin R. Fuller

*Attorney, Agent, or Firm*—Stephenson and Boller

[57] ABSTRACT

A sound barrier system particularly suited for out-of-doors, ground-mounted installations, such as for a highway noise barrier, comprises a vertical wall composed of successive individual wall sections arranged with immediately adjacent wall sections disposed at an intersecting angle to each other. Immediately adjacent wall sections are rigidly joined together in abutment along a common vertical joint. An earth anchor is anchored into the ground at each vertical joint. Each joint is secured to the corresponding earth anchor so that downwardly directed hold-down forces are applied by the earth anchors to the wall at the bottom portions of the joints.

10 Claims, 14 Drawing Figures

SOUND BARRIER SYSTEM

BACKGROUND AND SUMMARY OF THE INVENTION

The present invention pertains generally to sound barriers and is more specifically directed to an improved sound barrier construction for out-of-doors use, such as a highway noise barrier.

It is believed generally fair to say that highway noise is recognized as a significant environmental problem. The problem is most noticeable in the more congested areas where high-speed expressways or freeways pass through residential areas. Where a highway is depressed below ground level, the problem is less severe because of the adjacent embankments provided by the depressed construction. Where the highway is at or above ground level, the problem is more severe. In either case, the effect of highway noise can pose a serious environmental problem, particularly in residential areas.

In attempts to solve this problem, various construction techniques have heretofore been employed. For example, natural land berms are often utilized to provide a physical barrier between the highway and adjacent properties to deflect the noise from the traffic on the highway. While such natural berms may be aesthetically and environmentally pleasing, they do require heavy earth moving equipment for their construction, and they may also require additional construction work for drainage and other similar considerations. Also the berms may be covered with vegetation, such as grass or plants, which may require maintenance at relatively frequent periodic intervals. A further problem with a natural berm is that it occupies a rather substantial land area in order to achieve the necessary height which is required to be effective as a sound barrier; in other words, the higher the berm, the wider its base, and naturally a larger amount of fill is required to form the berm.

In attempts to provide alternate solutions for this problem, concrete sound barriers have also been developed and utilized as an alternative to natural berms. Such "concrete berms" do possess the advantage of requiring considerably less land area than natural berms; however, they possess a number of serious disadvantages. The use of concrete, due to its massive weight, dictates the necessity of very substantial and deep foundations and footings. Furthermore, such concrete berms typically require vertical posts which are embedded deeply in the earth and which project upwardly for essentially the full height of the barrier. Concrete wall sections between the vertical posts are typically pre-cast and installed between the posts to complete the installation. Because concrete berms may typically be employed where there are space limitations between the highway and the adjacent property, they can pose a safety hazard to highway traffic, should a vehicle, for whatever reason, leave the highway and collide with the concrete barrier. Thus, it is believed that concrete sound barrier berms do not provide a satisfactory solution to the reduction of highway noise along adjacent property.

The present invention is directed to a new and improved sound barrier system which affords a number of significant advantages and benefits over prior types of sound barriers and berms. Like the concrete barrier, the sound barrier of the present invention has the advantage of being suitable for installations where only limited space is available, yet it does not pose nearly the safety hazard to highway traffic that a concrete berm poses. The sound barrier of the present invention is more economical from the standpoint of more efficient use of lighter weight materials, and relative ease of erection. This means that heavy equipment and substantial foundation work are not required for installation of the sound barrier of the present invention. Indeed, at most, it may require light power equipment which can excavate a comparatively shallow trench, and the actual assembly and erection of the sound barrier of the present invention can be conducted by workmen using conventional hand tools, manual and/or power. The preferred embodiments of the present invention disclosed herein employ stress-skin panels each comprising a wood framework whose opposite sides are faced with plywood sheets. In one preferred embodiment, all panels are of the stress-skin type while in another, stress-skin panels alternate with plywood sheets. Immediately adjacent panels are in abutment along vertical joints and an earth anchor, embedded in the earth, is secured to the bottom portion of each joint. In the preferred embodiments, the included angle between immediately adjacent panels is obtuse, which promotes efficiency in the use of material along the overall length of the barrier in conjunction with good vertical stability and other attributes of the invention. The arrangement provides a material-efficient, light-weight, yet rigid, construction which is devoid of substantial vertical structural support members embedded in and projecting above the ground, such as the concrete posts of a concrete barrier. The barrier of the present invention can successfully withstand the environmental activity to which it is subjected, even high winds, yet in the event of being struck by an errant vehicle, it would not pose the safety hazard to vehicle occupants which a concrete barrier would pose. It is also less dependent on soil conditions than concrete barriers.

A further advantage is that the invention, in its preferred form, possesses the benefits of prefabricated construction for most all its component parts, yet at the same time it is versatile enough that a variety of embodiments may be constructed by relatively minor modifications to the prefabricated parts, as individual installation sites dictate.

The foregoing features, advantages and benefits of the invention, along with additional ones, will be seen in the ensuing description and claims which should be considered in conjunction with the accompanying drawings wherein like reference numerals designate like parts. The drawings disclose presently preferred embodiments of the invention in accordance with the best mode presently contemplated for carrying out the invention.

DESCRIPTION OF THE PREFERRED EMBODIMENTS

Figure 1:
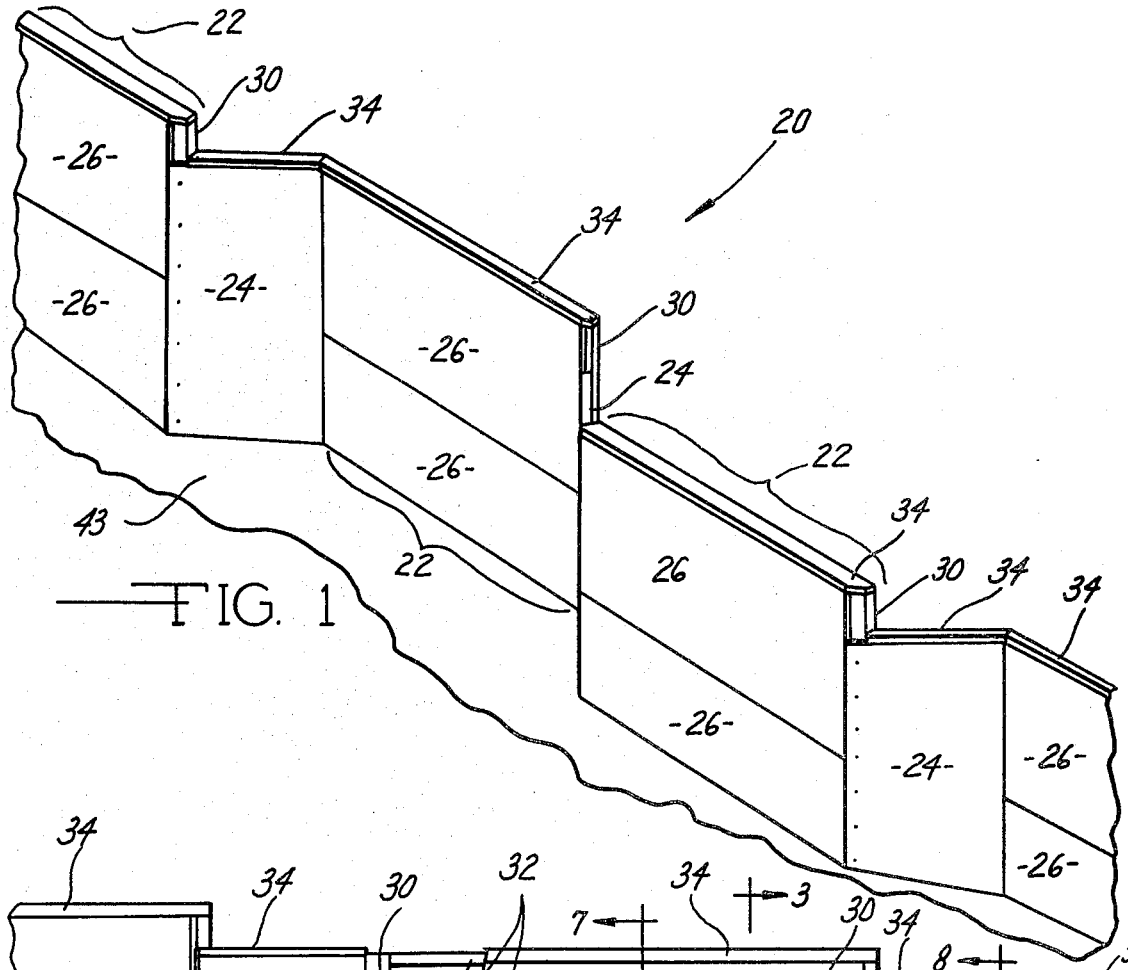
FIG. 1 is a perspective view of a first embodiment of sound barrier system embodying principles of the present invention.

A first embodiment of sound barrier 20, according to the present invention, is shown in FIG. 1 to comprise a plurality of larger wall sections 22, which are arranged alternately with respect to smaller wall sections 24. Wall sections 22 are generally parallel to and spaced from each other, and are joined by wall sections 24 which are at intersecting angles to the main wall sections 22. While the two types of wall sections 22, 24 are shown in FIG. 1 to be individually of uniform overall vertical height, although vertically staggered to follow the prevailing grade, each larger wall section 22 comprises two individual wall panels 26, and each smaller section 24 is a single panel section. The individual panels 26 are wood panels commonly known as stress-skin panels. Each stress-skin panel comprises a framework (see FIGS. 2 and 3) composed of vertically spaced horizontal studs 28 which are joined at the ends by vertical studs 30. Plywood skins 32 are secured to the framework on opposite sides to act as facings.

Figure 7:
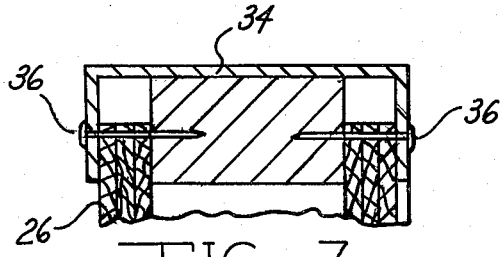
FIG. 7 is a vertical sectional view, on an enlarged scale, taken in the direction of arrows 7—7 in FIG. 2.
Figure 8:
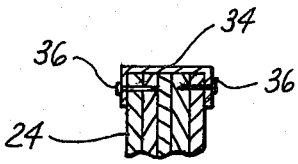
FIG. 8 is a vertical sectional view, on an enlarged scale, taken in the direction of arrows 8—8 in FIG. 2.
Figure 9:
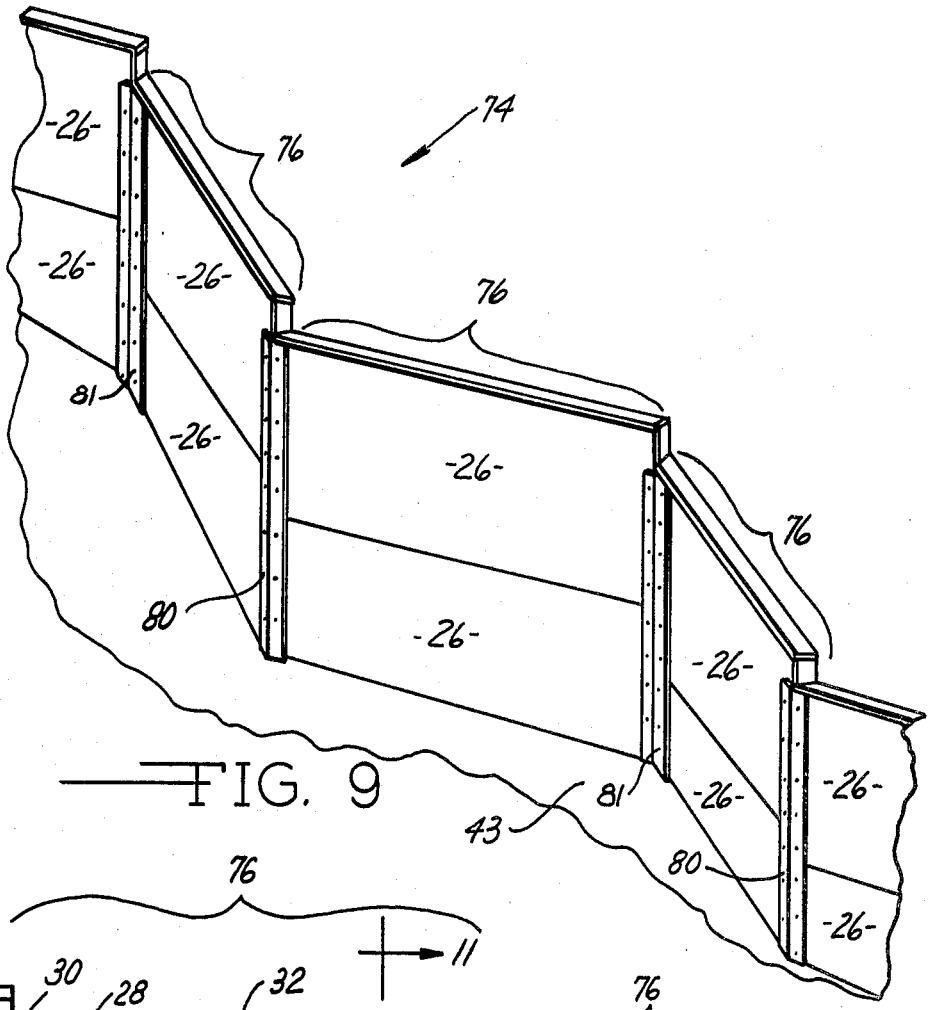
FIG. 9 is a perspective view of a second embodiment of sound barrier embodying principles of the present invention.

The panels 26 are preferably prefabricated at the factory and then shipped to the installation site where they may be installed expeditiously to fulfill the site requirements with a minimum of modification. As can be best seen in FIG. 3 the uppermost horizontal stud 28 of each panel 26 is set upwardly slightly outwardly beyond the upper horizontal edges of the skins 32 and the lowermost horizontal stud 28 is set inwardly of the lower horizontal edges of the skins 32 to provide a tongue and groove construction whereby the panels may be conveniently vertically stacked one on top of the other to accommodate heights greater than that of the standard individual panel. A channel cap 34, aluminum for example, covers the top of the uppermost panel and may be secured by nails 36 driven as shown in FIG. 7.

The panels 24 are individual plywood sheets and do not possess a frame and skin structure as do the stress-skin panels. All panels, however, are preferably treated by factory procedures, for example pressure treating, to provide long-term protection against out-of-doors conditions. A cap 34 may also cover the top of each panel 24.

Figure 5:
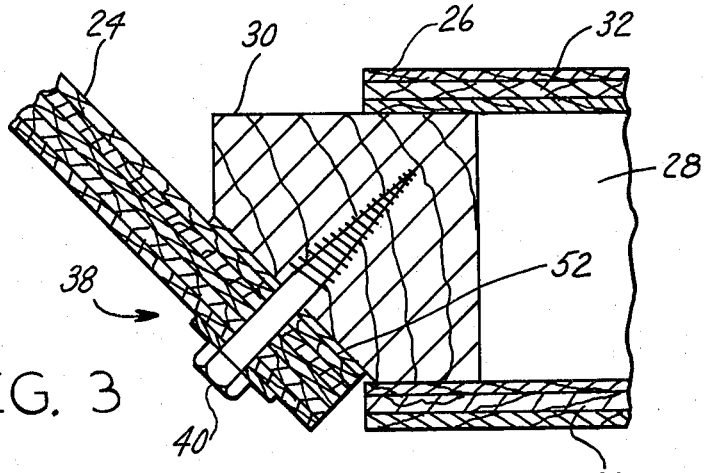
FIG. 5 is an enlarged horizontal sectional view taken in the direction of arrows 5—5 in FIG. 2.

FIG. 5 best illustrates the details of a joint 38 which is provided between immediately adjacent wall sections 22,24. It will be observed that the vertical studs 30 are set slightly outwardly beyond the vertical edges of the skins 32. One of the protruding corners of each vertical stud is mitered at the appropriate angle to provide a surface against which the vertical edge margin of the immediately adjacent wall section 24 is abutted. In the disclosed embodiment it can be seen that wall sections 24 are at 45 degree angles to the wall sections 22, and hence the mitering of the vertical studs is at a forty five degree angle. It will be noted that depending upon installation requirements, the angle could be changed if it were desired to change the angular relationship between immediately adjacent wall sections 22,24 to accommodate a substantial range of angles.

The mitering of the studs can be done either in the prefabrication process or at the job site, depending upon the individual requirements. Where a sound barrier is to run lengthwise in a generally straight line, i.e. meaning the sections 22 are parallel with each other, a unique single panel 22 may be used for all such sections. Where it is necessary for the barrier as it runs its course to make a bend, then it may be preferable to do the mitering at the job site where it is most likely more convenient to determine the individual requirements for installing the individual wall sections. Even at this, it will be appreciated that this can be done with simple hand tools and without a great deal of extra effort. The immediately adjacent panels are securely fastened together at their common joints by means of fasteners, such as lag screws, 40 shown in the drawing figures which run through wall section 22 into vertical stud 30. In this way the immediately adjacent panels are secured together in overlapping fashion to impart rigidifying structure to the successive wall sections along the entire wall length.

Figure 2:
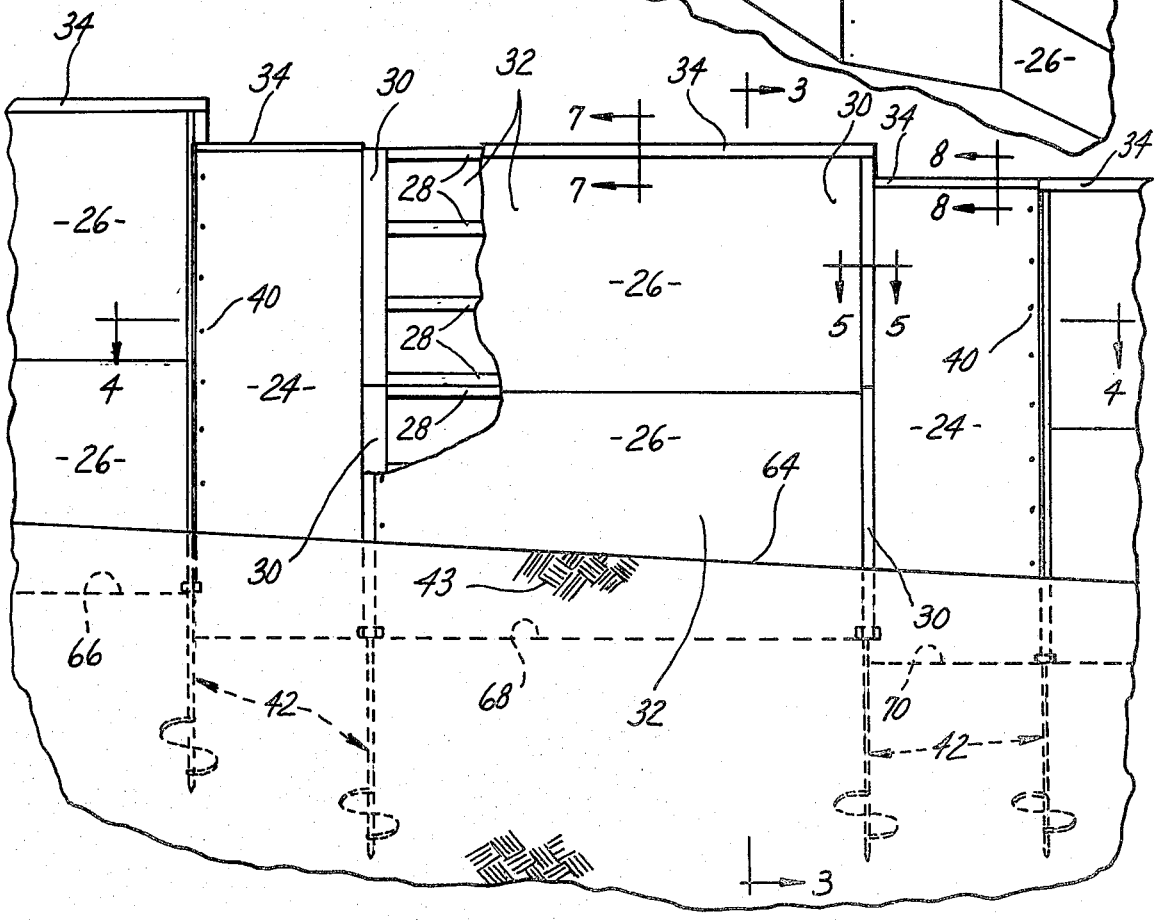
FIG. 2 is a front vertical elevational view of the embodiment shown in FIG. 1, with portions broken away.
Figure 3:
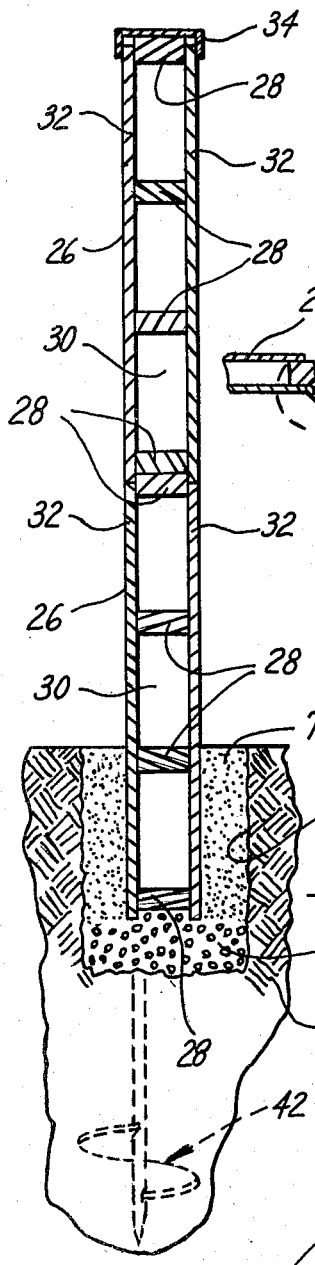
FIG. 3 is a vertical sectional view, on a slightly enlarged scale, taken in the direction of arrows 3—3 in FIG. 2.
Figure 4:
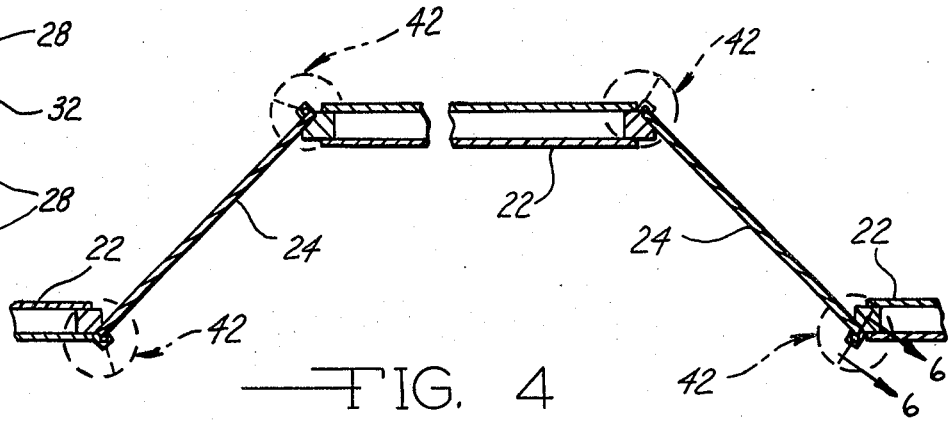
FIG. 4 is a horizontal sectional view, having a portion broken away, taken in the direction of arrows 4—4 in FIG. 2.

In FIG. 2 a typical complete sound barrier installation is shown, including the anchoring structure via which the barrier is tied to ground 43. The anchoring structure comprises an individual earth anchor 42 for each vertical joint 38. The preferred earth anchor is an auger type anchor comprising a screw-type auger portion 44 and an upwardly projecting rod portion 46 including a thread 48 at the upper end of the rod. The auger is anchored into the earth in conventional fashion to a level which leaves thread 48 exposed for attachment of the sound barrier wall at each joint 38. The auger-type earth anchor avoids the use of concrete foundation work, it promotes expedient installation, and it is compatible with different soil conditions, all while providing good hold-down characteristics.

Figure 6:
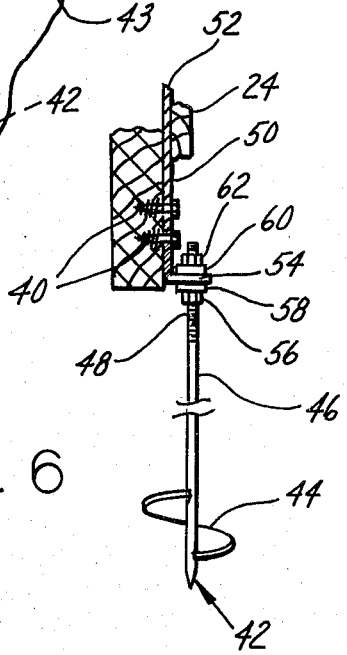
FIG. 6 is a vertical sectional view, on an enlarged scale with a portion broken away, taken in the direction of arrows 6—6 in FIG. 4.

The actual connection of each earth anchor 42 to the corresponding joint 38 takes place at the lower portion of each joint and as can be seen in FIG. 6 is provided by a connecting structure which includes an anchor strap 50. The anchor strap is a right angle metal piece having an upright portion 52 disposed against the mitered portion of the vertical stud 30 of the joint and a horizontal portion 54 containing an aperture through which the thread 48 extends. The very bottom of portion 52 is fastened directly to stud 30 by lag screws 40; the remainder of portion 52 is secured between panel 24 and stud 30 (see FIG. 5). Prior to the actual erection of a wall section, earth anchors are augured into the ground at the appropriate locations, and a nut 56 is threaded onto the thread 48 to a desired vertical elevation. A washer 58 is next applied over nut 56, and then the panel sections may be erected by inserting the anchor straps 50 onto the upper ends of the earth anchor rods. The attachment is finalized by next adding a washer 58 and a hold-down nut 60 which is tightened to securely mount the wall to the earth anchor. In this way a downwardly directed hold-down force is applied by each earth anchor to the corresponding joint. This arrangement provides a rigid wall structure which is well anchored to the earth.

In order to further improve upon the stability of the sound barrier wall, for example where high winds may be encountered, it may be desirable to provide a shallow trench for the wall. In FIG. 2 the grade line for the ground is designated by the reference numeral 64 and a stepped trench is provided below grade as shown. The illustrated trench comprises trench sections 66, 68, 70 each at a successively lower elevation from left to right in the drawing figure. It will be noted that the trenching need not be much wider than the individual wall sections themselves, and the depth of the trench does not have to be great. Thus relatively light construction equipment can be utilized, as opposed to the heavier construction equipment required for the concrete type barriers and the natural earth berms. The usual trenching technique involves the bottom of the trench being filled with a gravel layer 69, six inches deep for example. The wall sections are placed in the trench on the gravel, and then the remainder of the trench is back-filled with dirt 71.

It will be observed that where trenching is used, the actual connection of the earth anchors to the wall sections may take place below grade, and thus after the trench is back-filled, the attachment is entirely concealed from view, thereby improving the aesthetic quality of the construction. Hence, principles of the invention provide a rigid and effective sound barrier structure which avoids the disadvantages of concrete barriers and earth berms. Particularly there are no vertical uprights which are embedded in the ground and which project upwardly any substantial distance beyond the ground surface. Furthermore, the hollow wall construction of the wall sections 22, as well as the single thickness construction of the wall sections 24 is such that in event of being struck by a vehicle, the barrier would impose a significantly reduced impact force on the vehicle than would be the case for a concrete sound barrier.

It will be also appreciated that by virtue of their wood construction, the panels may be handled manually on the erection site and the actual erection may be accomplished by personnel utilizing small hand tools, either manual or power. It is entirely unnecessary to utilize large construction equipment for erecting a sound barrier in accordance with the present invention. Thus, it can be seen that the invention possesses a number of important advantages over previous types of sound barriers used for highway noise reduction.

FIGS. 9 through 14 illustrate a second embodiment of sound barrier 74 embodying principles of the present invention. The second embodiment, as disclosed, utilizes identical wall sections 76, as distinguished from the first embodiment which utilizes two different types of wall sections 22,24. Basically each wall section 76 is substantially identical to a wall section 22 of the first embodiment in that each of its two vertically stacked panels 26 comprises a series of vertically spaced horizontal studs 28 (See FIGS. 10 and 11) which are joined at their ends by vertical studs 30 and covered on opposite sides by skins 32.

One difference between the two embodiments is that in embodiment 74, the vertical studs 30 are mitered in a different fashion from the first embodiment. The mitering can be seen in FIGS. 12, 13, and 14 whereby the vertical studs of immediately adjacent wall sections are cut to abut each other along their respective miters in non-overlapping fashion. Like the first embodiment, the arrangement allows for a range of miter angles to accommodate a range of angular orientations between immediately adjacent wall sections. Where the construction is such that the wall is to run generally in a single direction the individual wall sections may be made identical so that all alternate wall sections are parallel to each other. If it becomes necessary for the wall to follow a curve or bend, then the miter angles may be adjusted to allow the wall to follow the contour of the curve or bend. In this regard it is possible to achieve even sharper angles of intersection between the individual wall sections by including filler studs between the vertical studs 30 of the abutting wall sections. Hence, a substantial range of angular orientations may be achieved with the invention although relatively larger obtuse included angles will minimize the number of individual sections required.

The actual joint 78 between immediately adjacent wall sections comprises the wall sections being in contacting abutment with each other and the abutment secured by means of a pair of metal joining strips 80, 81 disposed on opposite sides of the wall sections. The metal joining strips are bent at a suitable angle and overlap the two immediately adjacent wall sections while running vertically lengthwise of the joint. There are suitable apertures provided in the strips 80, 81 and corresponding holes in the two wall sections to provide for attachment by means of bolts 82 which are passed through the apertures and holes and secured by nuts 84. It will be observed that the purpose of the metal joining strips is simply to secure the two adjacent wall sections in abutment and the metal joining strips are entirely unlike a vertical upright, such as the concrete post in the case of a concrete sound barrier.

Figure 10:
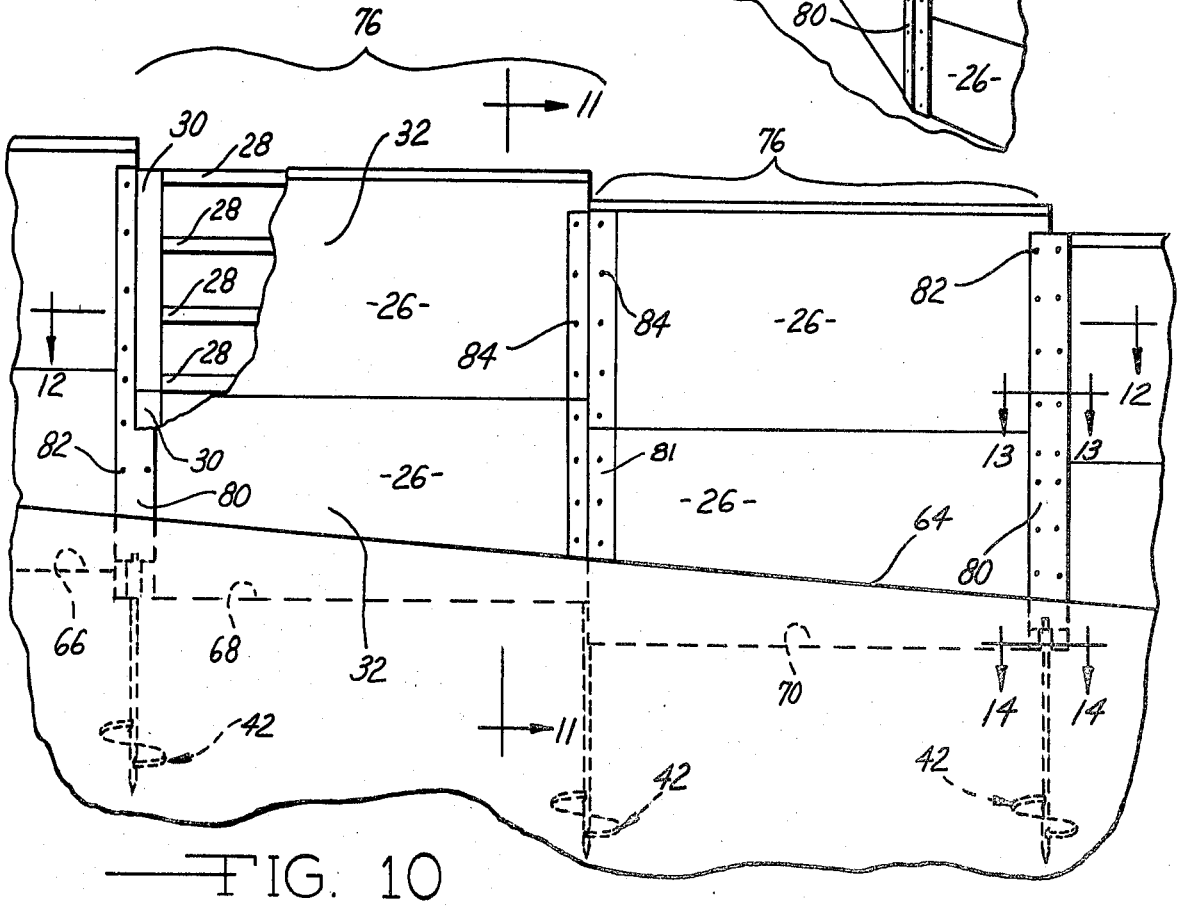
FIG. 10 is a front vertical elevational view of the embodiment of FIG. 9 with portions broken away.
Figure 11:
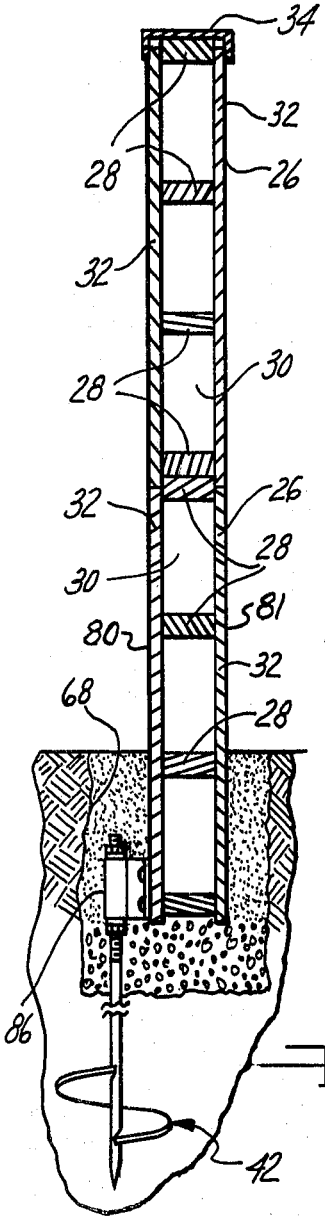
FIG. 11 is a vertical sectional view, on an enlarged scale, taken in the direction of arrows 11—11 in FIG. 10.
Figure 12:
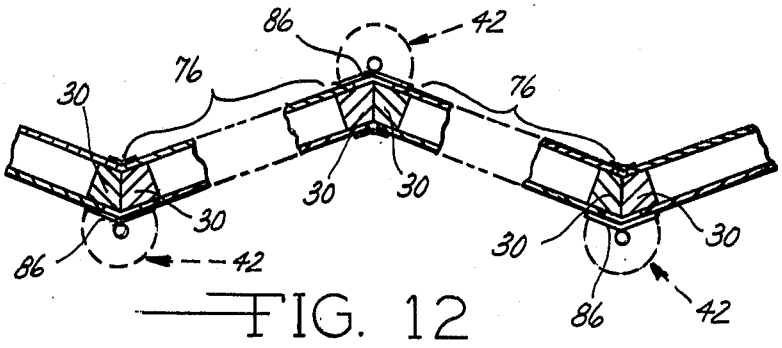
FIG. 12 is a horizontal sectional view, having portions broken away, taken in the direction of arrows 12—12 in FIG. 10.
Figure 13:
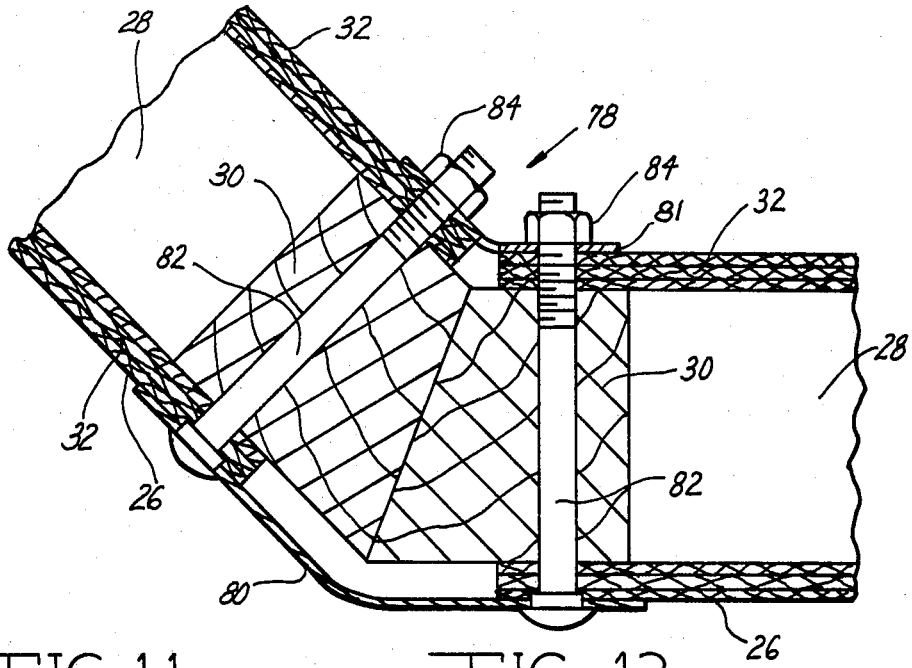
FIG. 13 is a horizontal sectional view, on an enlarged scale, taken in the direction of arrows 13—13 in FIG. 10.
Figure 14:
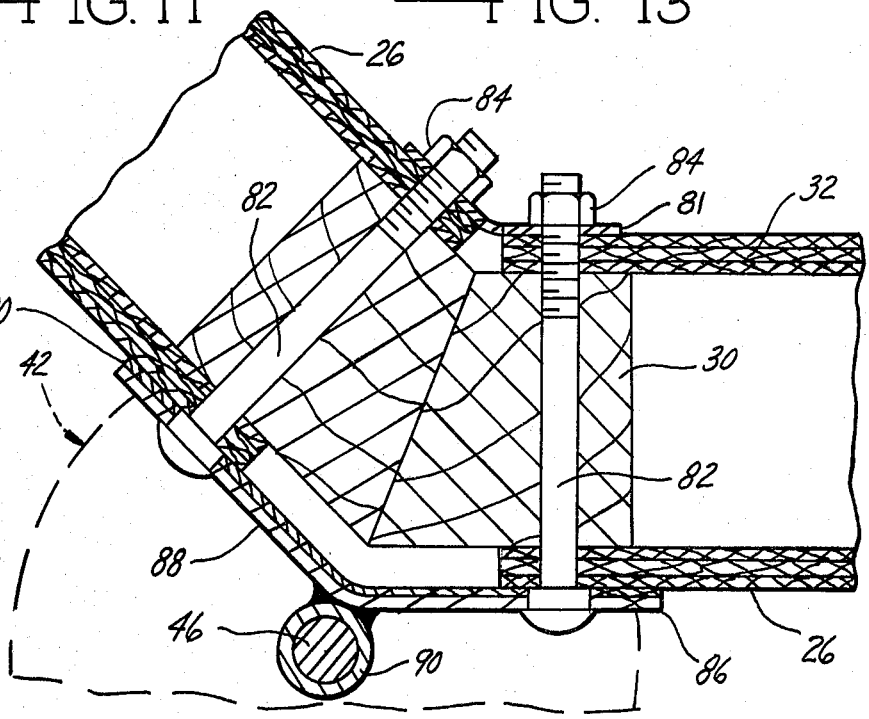
FIG. 14 is a horizontal sectional view, on an enlarged scale, taken in the direction of arrows 14—14 in FIG. 10.

In accordance with principles of the invention, earth anchors 42 are also employed to anchor the second embodiment of sound barrier 74 to the ground. In this embodiment the connection of each ground anchor to the corresponding vertical joint 78 is provided by a connector 86 which is secured to the bottom portion of each joint by bolts 82 and nuts 84. The illustrated connector 86 comprises a sturdy metal plate 88 formed as shown and a vertically oriented tube 90 secured to plate 90 as by welding. Earth anchors 42 are first embedded in the ground at the desired locations, and then the wall sections are erected with the tubes 90 fitting over the threaded end of the earth anchor rods and the hold-down attachment being effected by nuts and washers. In this way, as in the first embodiment, each earth anchor exerts a downwardly directed hold-down force at the bottom portion of each corresponding joint 78. As can be seen in FIG. 10 the second embodiment is susceptible to a similar type of installation as the first embodiment wherein the wall is mounted in a relatively shallow trench which may have different elevational levels dependent upon the prevailing grade. Where the wall is erected along a grade, there may be some vertical staggering of the individual wall sections as shown in FIG. 10, and as in FIG. 2 of the first embodiment. An advantage of the present invention is that the prefabricated construction, coupled with the limited amount of on-site fabrication and assembly, mean that the requirements of the particular installation may be expeditiously handled in the field without the need to make any substantial modifications, if at all, to the prefabricated wall sections. The many features of the invention make it effective from the standpoints of both cost and performance.

While principles of the invention may be applied to various design requirements and specifications, the preferred embodiments disclosed herein utilize conventional four foot by eight foot stress-skin panels 26 which are in accordance with American Plywood Association standards. Other size panels may obviously also be used if desired. An important advantage of a stress-skin panel is that it provides significant resistance to racking. Moreover, by using chromated copper arsenate pressure-treated lumber and plywood for the panels, there is provided long term protection against decay and insect damage. The plywood skins allow for the incorporation of various ornamental designs, such as grooving, as well as staining, thereby improving the aesthetic appearance of the barrier. The panels are also suitable for supporting clinging vine-like vegetation. If desired, the aluminum channel caps 34 may be anodized to match the plywood skin of the panels. The particular requirements for the auger-type earth anchor will depend upon the particular soil conditions, and expected design loads. Also the decision of whether or not to trench will depend upon a particular installation, but in any event the amount of trenching is a relatively small proportion of the total height of the overall barrier. For example, for an eight foot high barrier it is expected that an embedded depth of one foot and exposed height of seven feet can successfully withstand a one hundred mile per hour wind when utilizing an eleven thousand pound earth anchor with a maximum soil pressure of 3.0 ksf. Effective sound reflection is promoted by the ziz-zag type layout of the wall and the hollow core construction of the stress-skin panels, and wood is believed to exhibit better sound absorption characteristics than concrete. Should it be deemed desirable, the wall sections having hollow interior spaces, such as wall sections 22 and 76, may include a sound deadening material filling the voids. Any of a number of conventional sound deadening materials may be used.

The foregoing discloses a new and improved sound barrier system well suited for out-of-doors installation, particularly for use as a highway noise barrier. While preferred embodiments of the invention have been disclosed, it will be appreciated that various modifications may be made within the scope of the principles of the invention which are set forth in the following claims.

It is claimed:

1. An out-of-doors, ground-mounted, vertical wall sound barrier system comprising a vertical wall composed of successive individual wall sections arranged with immediately adjacent wall sections disposed at an intersecting angle to each other and in abutting relationship to each other along a vertical joint, means joining immediately adjacent wall sections together and holding them in their abutting relationship along the corresponding vertical joint, an earth anchor anchored into the ground at each joint, means securing the bottom portion of each joint to the corresponding earth anchor such that a downwardly directed hold-down force is applied by each anchor to the corresponding joint and wherein at least one of said wall sections comprises a stud frame including a vertical stud member at one vertical joint and a sheet covering one side of the frame including a vertical edge margin secured to said vertical stud member but with the vertical edge of the vertical edge margin of the sheet set inwardly from the outside vertical perimeter of the frame defined by said vertical stud and wherein the immediately adjacent wall section to said vertical stud is in abutment with that portion of said vertical stud which is set outwardly from said vertical edge of the sheet.

2. A sound barrier system as set forth in claim 1 wherein said vertical stud comprises a surface facing generally in the direction of its immediately adjacent wall section and said immediately adjacent wall section comprises a surface facing generally toward said vertical stud with said two surfaces being disposed in contacting abutment with each other.

3. A sound barrier system as set forth in claim 2 wherein said joining means comprises a joining strip which overlaps both said at least one wall section and the wall section immediately adjacent said vertical stud of said at least one wall section, said joining strip being attached to said vertical stud of said at least one wall section and to said immediately adjacent wall section.

4. A sound barrier system as set forth in claim 1 wherein said vertical stud includes a surface which is disposed at an angle to said sheet which angle is equal to the intersecting angle between said at least one wall section and the wall section immediately adjacent said vertical stud and wherein said immediately adjacent wall section comprises a vertical marginal portion which is in abutment with said surface of said vertical stud.

5. A vertical wall sound barrier system as set forth in claim 4 wherein said joining means comprises one or more fasteners which pass through said vertical marginal portion of said immediately adjacent wall section and said vertical stud of said at least one wall section.

6. A sound barrier system as set forth in claim 1 wherein said securing means comprises a connector member secured at least in part to said vertical stud at the bottom portion thereof and means fastening said connector member to the corresponding earth anchor.

7. A sound barrier system as set forth in claim 5 wherein the earth anchor for said vertical stud comprises an auger embedded in the earth with a vertical rod portion projecting upwardly from the auger including an upper threaded portion and said connector member comprises aperture means, said rod portion projecting upwardly through said aperture means, and including a nut threaded onto said threaded portion of said rod to secure the connector member to the earth anchor.

8. An out-of-doors, ground-mounted, vertical wall sound barrier system comprising a vertical wall composed of successive individual wall sections arranged with immediately adjacent wall sections disposed at an intersecting angle to each other and in abutting relationship to each other along a vertical joint, means joining immediately adjacent wall sections together and holding them in their abutting relationship along the corresponding vertical joint, an earth anchor anchored into the ground at each joint, means securing the bottom portion of each joint to the corresponding earth anchor such that a downwardly directed hold-down force is applied by each anchor to the corresponding joint and wherein said wall sections are identical and include vertical studs in abutment with each other to provide each vertical joint, and the earth anchors are disposed alternately on opposite sides of the wall and are secured to the vertical studs forming each vertical joint.

9. An effective and economical, out-of-doors, vertical wall highway sound barrier system devoid both of concrete and of any substantial vertical structural support members embedded in the ground, yet capable of withstanding environmental activity including high wind forces, said system comprising a vertical wall composed of successive wall sections arranged with immediately adjacent wall sections disposed at an intersecting angle to each other and in abutting relationship to each other along a common vertical joint, means joining immediately adjacent wall sections together and holding them in their abutting relationship along the corresponding vertical joint, each wall section being embedded in the ground along the length of its bottom edge margin for a small fraction of its height, an earth anchor comprising an auger anchored into the ground at each joint, and means securing the bottom portion of each joint to the corresponding earth anchor such that a downwardly directed hold-down force is applied by each earth anchor to the corresponding joint.

10. A sound barrier system as set forth in claim 9 wherein the entirety of the earth anchors and the securing means are disposed below grade level and covered by a back-fill so as not to be visible when the wall is viewed by an observer.

* * * * *